US006262524B1

(12) United States Patent
Ouchi

(10) Patent No.: US 6,262,524 B1
(45) Date of Patent: Jul. 17, 2001

(54) ELECTRON GUN WITH ELECTRON BEAM CONVERGING MEMBER DISPOSED BETWEEN QUADRUPOLE AND MAIN LENS AND A CATHODE RAY TUBE EMPLOYING THE SAME

(75) Inventor: Yoshihiro Ouchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/061,785

(22) Filed: Apr. 17, 1998

(30) Foreign Application Priority Data

Apr. 21, 1997 (JP) ..... 9-103643

(51) Int. Cl.[7] ..... H01J 29/50
(52) U.S. Cl. ..... 313/414; 335/210; 348/805
(58) Field of Search ..... 313/364, 409, 313/411, 414; 335/210, 212, 213; 348/810, 805, 806, 808, 809

(56) References Cited

U.S. PATENT DOCUMENTS 4,703,223 * 10/1987 Iguchi et al. ..... 313/414
4,922,166 * 5/1990 Ichida et al. ..... 313/414
5,488,264 * 1/1996 Ota et al. ..... 313/412
5,751,100 * 5/1998 Kim ..... 313/414

* cited by examiner

*Primary Examiner*—Nimeshkumar D. Patel
*Assistant Examiner*—Matthew J. Gerike
(74) *Attorney, Agent, or Firm*—Ronald P. Kananen; Rader, Fishman & Grauer

(57) ABSTRACT

A color cathode ray tube, and an electron gun of the same, having a superior focus characteristic. An electron gun is provided, emitting electron beams through a Gla electrode, G2*a* electrode, GMAa electrode, GMBa electrode, and G3 electrode. The electrons from a quadrupole and main focus lenses. Three cathodes 12B, 12B, etc. for discharging R, G, and B electron beams are provided in parallel with each other. A cup-shaped conductive member 60 is affixed to the GMBa electrode at the downstream side of the quadrupole lens formed by the GMAa electrode and GMBa electrode. The two side electron beams are oriented toward the center electron beam by the potential difference between the cup-shaped conductive member 60 and G3 electrode.

20 Claims, 5 Drawing Sheets

ELECTRON GUN WITH ELECTRON BEAM CONVERGING MEMBER DISPOSED BETWEEN QUADRUPOLE AND MAIN LENS AND A CATHODE RAY TUBE EMPLOYING THE SAME

BACKGROUND OF THE INVENTION

1. Field of the Invention

The present invention relates to an electron gun for a color cathode ray tube. More particularly the invention relates to an electron gun for a color cathode ray tube provided with a mechanism for deflecting the electron beams from cathodes to make the beams cross at the downstream side of a quadrupole lens and a cathode ray tube using the same.

2. Description of the Related Art

FIG. 4 is a cross-sectional view for explaining the internal structure of a Trinitron electron gun 1, while FIG. 5 is an enlarged view of the portion of FIG. 4 surrounded by the broken line. Note that, a half side to the left of the center axis is shown in FIG. 5.

As shown in FIG. 4 and FIG. 5, the Trinitron gun 1 is provided with cathodes 2 comprising a red cathode 2R and a blue cathode 2B arranged in-line around a green cathode 2G. The cathodes 2R, 2G, and 2B respectively emit a red, green, and blue electron beam.

From the cathodes 2 to the downstream emission of the electron the beams successively encounter a G1 electrode, G2 electrode, GMA electrode, GMB electrode, G3 electrode, G4 electrode, convergence electrode CONV, aperture grille (not shown), and three-color phosphor screen stripes (not shown). The electrodes are each provided with three openings (beam through holes) through which the red, blue, and green electron beams pass. For example, as shown in FIG. 5 the GMA electrode and the GMB electrode are each provided with beam through holes 9A and 9B through which the red electron beam passes, beam through holes 10A and 10B through which the green electron beam passes, and the beam through holes (not shown) through which the blue electron beam passes.

Here, the G1 electrode is for example supplied with a voltage of 0V. To simplify the structure, it is formed integrally with the cathodes 2. Further, the cathodes 2 are supplied with a voltage of 40 to 170V.

The G2 electrode, GNA electrode, GMB electrode, and G3 electrode cooperate to form a focus lens which bends the electron beams slightly inward around the green electron beam. Note that the G2 electrode is supplied with a voltage of 500V, the GMA electrode is supplied with a voltage of 7000V, the GMB electrode is supplied with a voltage of 7000V, and the G3 electrode is supplied with a voltage of 29000V.

Here, the voltage applied to either the GMA electrode and the GMB electrode is fixed, while the voltage applied to the other is variable.

Note that the distance L1 between the emission surface of the cathode 2G and the G1 electrode is about 0.1 mm, the distance L2 between the G1 electrode and the G2 electrode is about 0.4 mm, the distance L3 between the G2 electrode and the GMA electrode is about 1 mm, the distance L4 between the center of the GMA electrode and the center of the GMB electrode is about 0.5 mm, and the distance L5 between the GMB electrode and the left side end of the G3 electrode in the figure is about 2.0 mm.

The GMA electrode and the GMB electrode form a quadrupole lens for correcting the aspect ratio of the cross-section of the electron beam spot In order to obtain a good electron beam spot over the entire region of the phosphor s creen, that is, a good focus characteristic.

The G3 electrode, G4 electrode, and G5 electrode form a larg e diameter main focus lens (main lens) about which the beams cross. The red and blue electron beams cross, then spread out toward the outside and are deflected by the convergence electrode CONV to pass through the aperture grille and converge at the three-color phosphor screen.

In this way, the Trinitron electron gun 1 is configured with a single main lens for the three electron beams.

In the conventional Trinitron electron gun 1, however, with only the prefocus lens composed of the G2 electrode, GMA electrode, GMB electrode, and G3 electrode, it is not possible to sufficiently bend the electron beams so as to cross the beams in the main focus lens, so as shown in FIG. 1 and FIG. 2, the cathodes 2R and 2B are provided inclined by a predetermined angle toward the center axis Z.

Alternatively, instead of inclining the cathodes 2R and 2B, it is possible to arrange them in parallel with the cathode 2G (center axis Z) and use the voltage occurring at a cup-shaped wall surface provided in the vicinity of the outer circumference of the G2 electrode to bend the red and blue electron beams toward the center axis Z.

In the above Trinitron electron gun 1, however, If the cathodes 2R and 2B are arranged at an angle, the red and blue electron beams will strike the quadrupole lens composed the GMA electrode and the GMB electrode at an angle in accordance with that, so there will be the problem that the clearance between the beam through holes provided at the GMA electrode and GMB electrode and the beam paths will become small and, due to optical aberration, a sufficient focus characteristic will not be obtained. Further, if the clearance between the beam through holes and the beam paths is small in this way, there will be the problem of a low freedom of design. Further, it will be necessary to use a sophisticated and expensive manufacturing apparatus to arrange the cathodes 2R and 2B inclined precisely by a predetermined angle with respect to the center axis Z in the manufacturing process-resulting in the problem of a high cost.

Further, in the method of providing a cup-shaped wall surface in the vicinity of the outer circumference of the G2 electrode, in addition to the problem of the inability to obtain a sufficient focus characteristic, due to the effect of the medium voltage electrodes provided between the G2 electrode and the G3 electrode, that is, the GNA electrode and the GMB electrode, there will be the problem of a difficulty in obtaining a sufficient potential difference for bending the electron beams to cross them.

SUMMARY OF THE INVENTION

The present invention was made in consideration of the above related art and has as its object the provision of a cathode ray tube having a superior focus characteristic and an electron gun of the same.

Another object of the present invention is to provide a color cathode ray tube having a high design freedom with its electron gun.

According to a first aspect of the present invention, there is provided an electron gun for a color cathode ray tube, comprising an electron beam emitter for emitting three electron beams an, intermediate voltage electrode for forming a quadrupole lens, an electron beam orienting means and high voltage electrodes forming a main lens. The electron beam orienting means is disposed between the quadrupole lens and main lens, and redirects two side electron beams from the emitter toward a center electron beam so that three electron beams emitted from the emitter cross in the main lens.

Preferably, the electron beam emitter is comprised of three cathodes arranged side by side so as to emit the three electron beams parallel to each other. Further, preferably, the orienting means is a conductive member to which a predetermined voltage is supplied and orients the electron beams by a potential difference with the high voltage electrodes of the main lens.

Preferably, the quadrupole lens is formed by at least a first intermediate voltage electrode and a second intermediate voltage electrode provided at a downstream side of the path of the electron beams from the first intermediate voltage electrode.

Preferably, the orienting means is a conductive tube provided so as to surround the beam through holes at a downstream side of the second intermediate voltage electrode.

Preferably, a single electron gun emits the three electron beams.

According to a second aspect of the present invention, there is provided a cathode ray tube with such an electron gun.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Below, an explanation will be given of a cathode ray tube (CRT) and an electron gun housed in the neck portion of the same according to an embodiment of the present invention.

Figure 1:
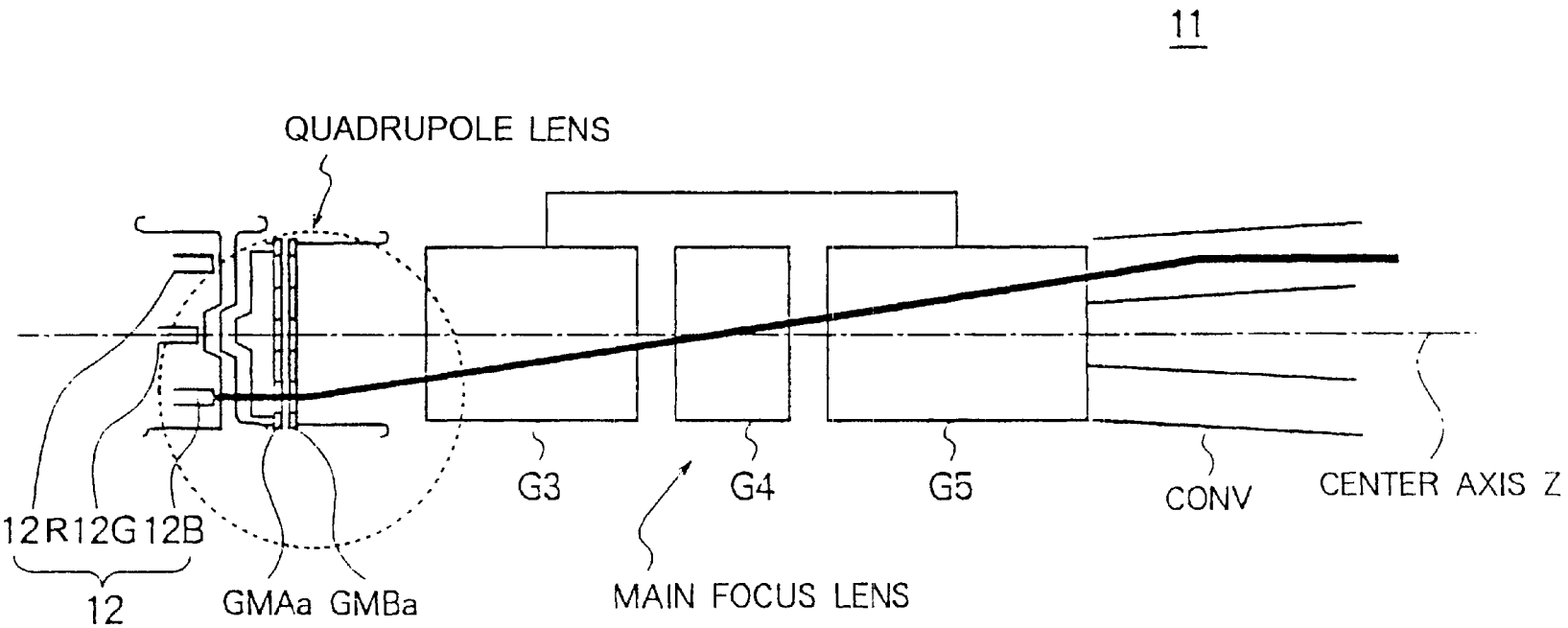
FIG. 1 is a cross-sectional view for explaining the internal structure of an electron gun; according to the present invention
Figure 2:
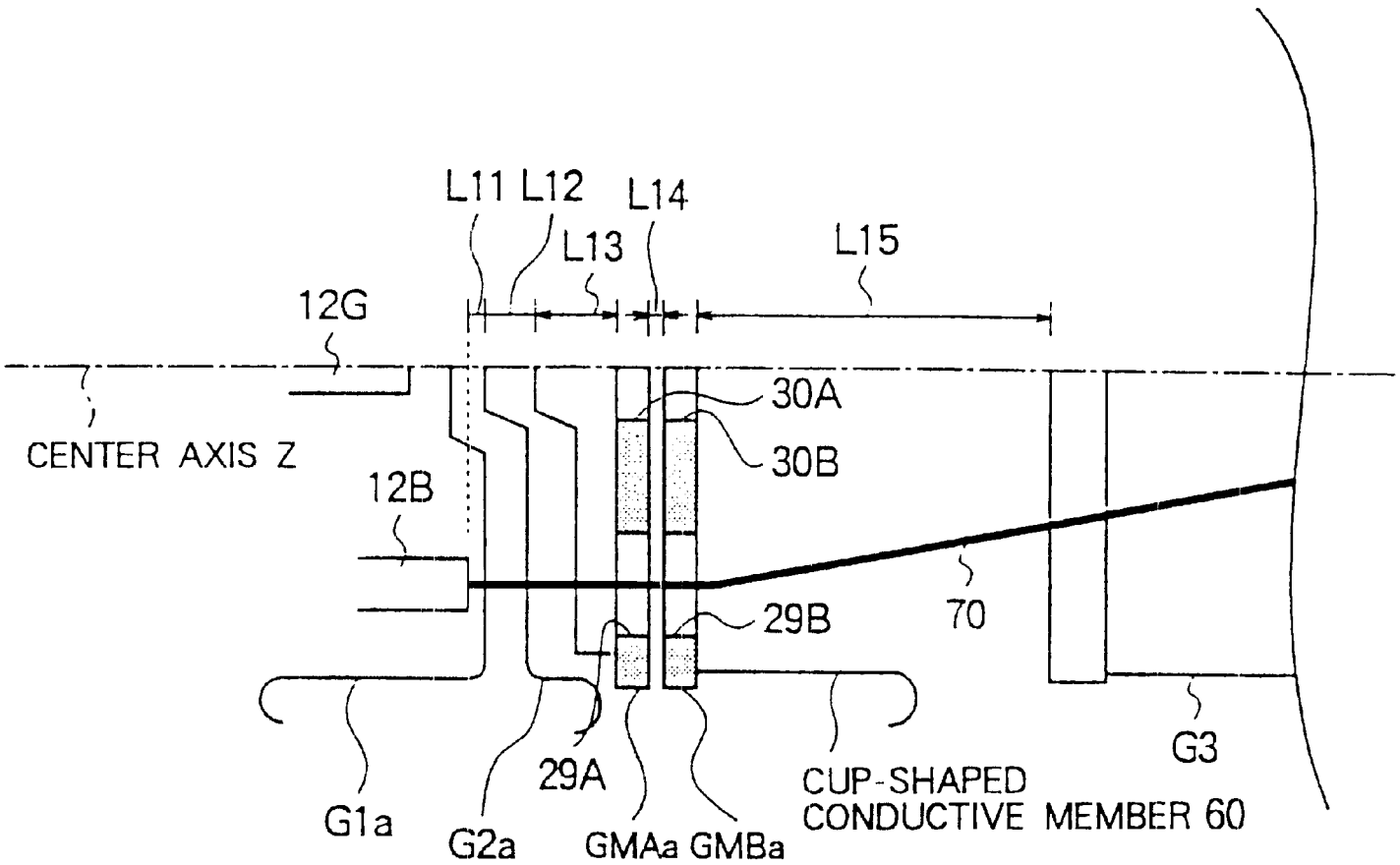
FIG. 2 is an enlarged view of the portion surrounded by a broken line in FIG. 1.
Figure 3:
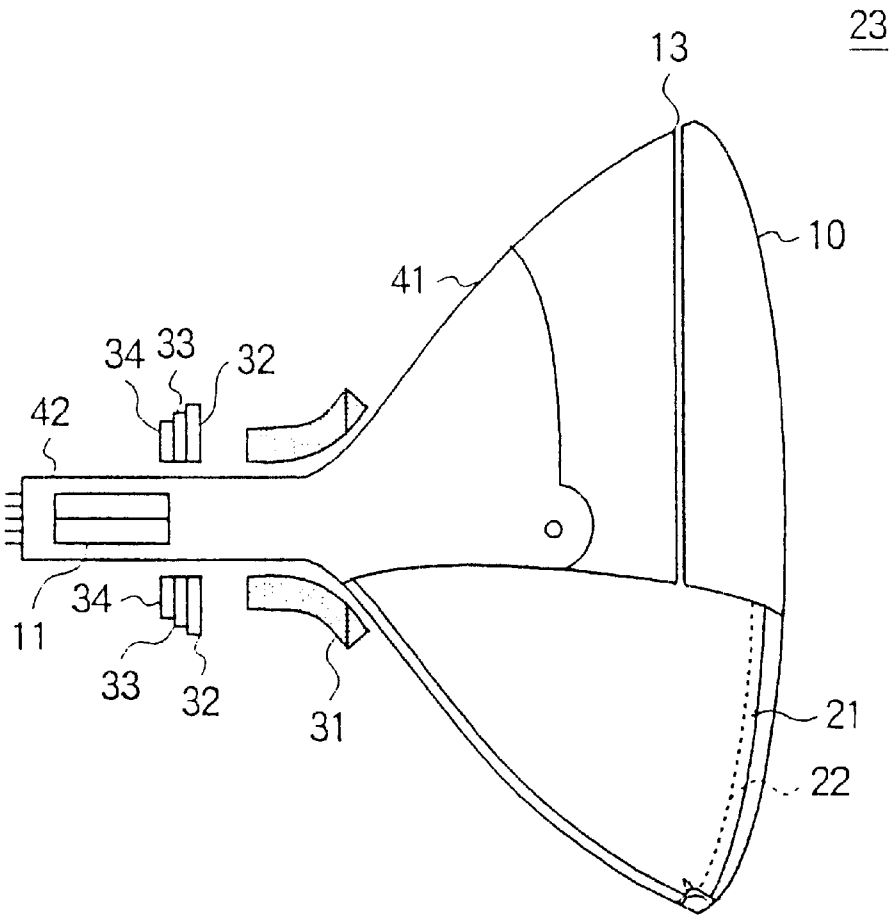
FIG. 3 is a cross-sectional view for explaining the internal structure of a Cathode ray tube with an electron gun according to an embodiment of the present invention.

FIG. 1 is a cross-sectional view for explaining the internal structure of an electron gun 11, FIG. 2 is an enlarged view of of the portion surrounded by the broken line in FIG. 1, and FIG. 3 is a plan view illustrating a partially cutaway section for explaining the overall configuration of a cathode ray tube 21.

Note that in FIG. 2, only the half side to the left of the center axis Z is shown.

First, an explanation will be given of the cathode ray tube 23 referring to FIG. 3.

The cathode ray tube 23 is comprised of vacuum envelop comprised of a panel 10, a funnel 41, and a neck portion 42. The panel 10 and the funnel 41 are joined by frit glass 13. On the inner surface of the panel 10 is formed a phosphor screen 21 comprised of blue, green, and red phosphors coated in stripes. An aperture grille 22 is disposed near the phosphor screen 21. Electron beams emitted from an electron gun 11 housed in the neck portion 42 are deflected in predetermined directions by a deflection yoke 31, pass through the aperture grille 22, and reach the phosphor screen 21 formed on the inner surface of the panel 10 where they excite predetermined phosphors and cause them to emit light.

Link-shaped correction magnets 32,33,34 for adjusting the paths of the red, green, and blue electron beams emitted from the electron gun 11 are arranged in the neck portion 42 of the cathode ray tube 23.

The correction magnets 32,33,34 are affixed at predetermined positions in the neck portion 42 in the order of the six-pole magnet 34, four-pole magnet 33, and two-pole magnet 32 from the electron gun 11.

Next, an explanation will be made of the electron gun 11 housed in the cathode ray tube 23.

As shown in FIG. 1 and FIG. 2, the Trinitron electron gun 11 is provided with cathodes 12 comprising an R (red) cathode 12R and a B (blue) cathode 12B arranged in-line about a G (green) cathode 12G.

The cathodes 12R, 12G, and 12B are arranged parallel to the center axis Z and emit red, green, and blue electron beams along the center axis Z.

The cathode 12G is arranged shifted to the left side in the figure by exactly a predetermined distance from the cathodes 12R and 12B so that the difference in optical paths of the red, green, and blue electron beams become the same.

Figure 5:
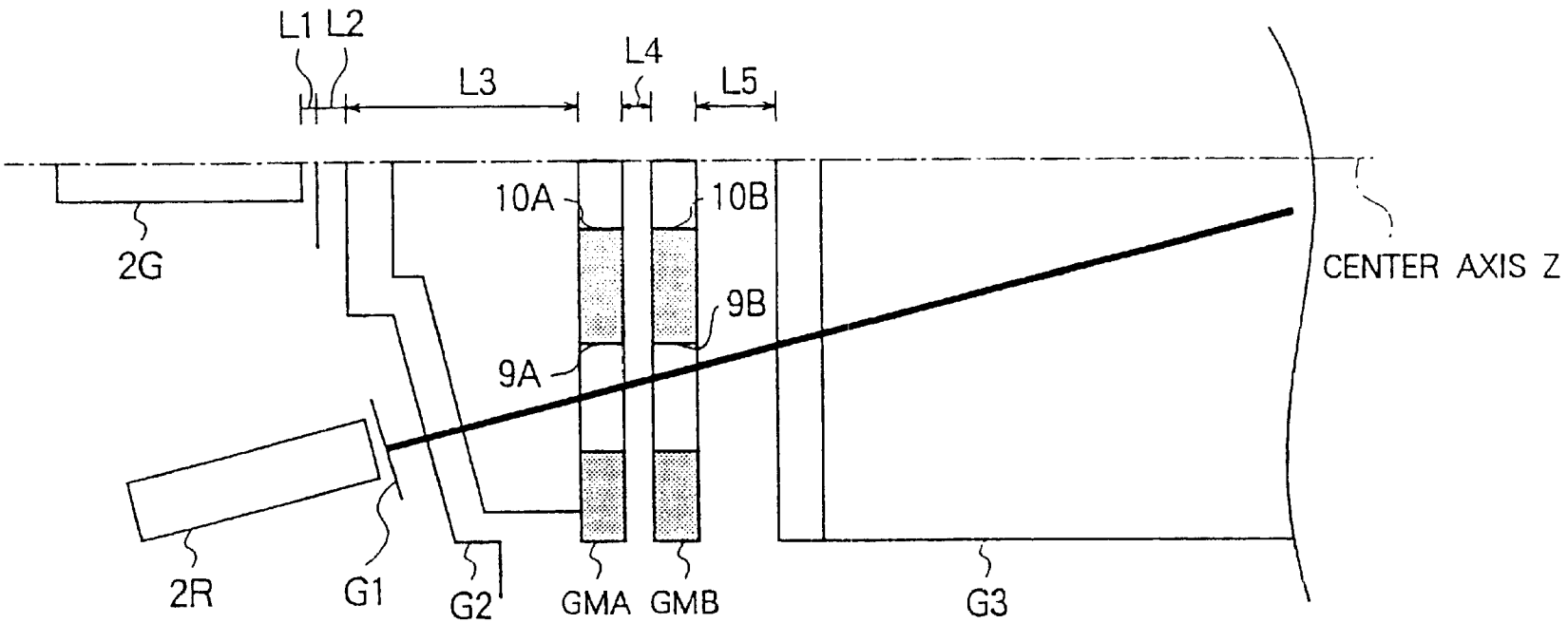
RELATED ART FIG. 5
FIG. 5 is aa enlarged view of the portion surrounded by 12 broken line in FIG. 4.

Provision is made, from the cathodes 12 toward the downstream side of emission of the electron beams, of a Gla electrode, G2a electrode, GMAa electrode as a first Intermediate voltage electrode, GMBa electrode as a second intermediate voltage electrode, G3 electrode, G4 electrode, and G5 electrode as high voltage electrodes, a convergence electrode CONV, and, shown in FIG. 5, an aperture grille 22 and three-color phosphor screen stripes 21, in that order.

Figure 4:
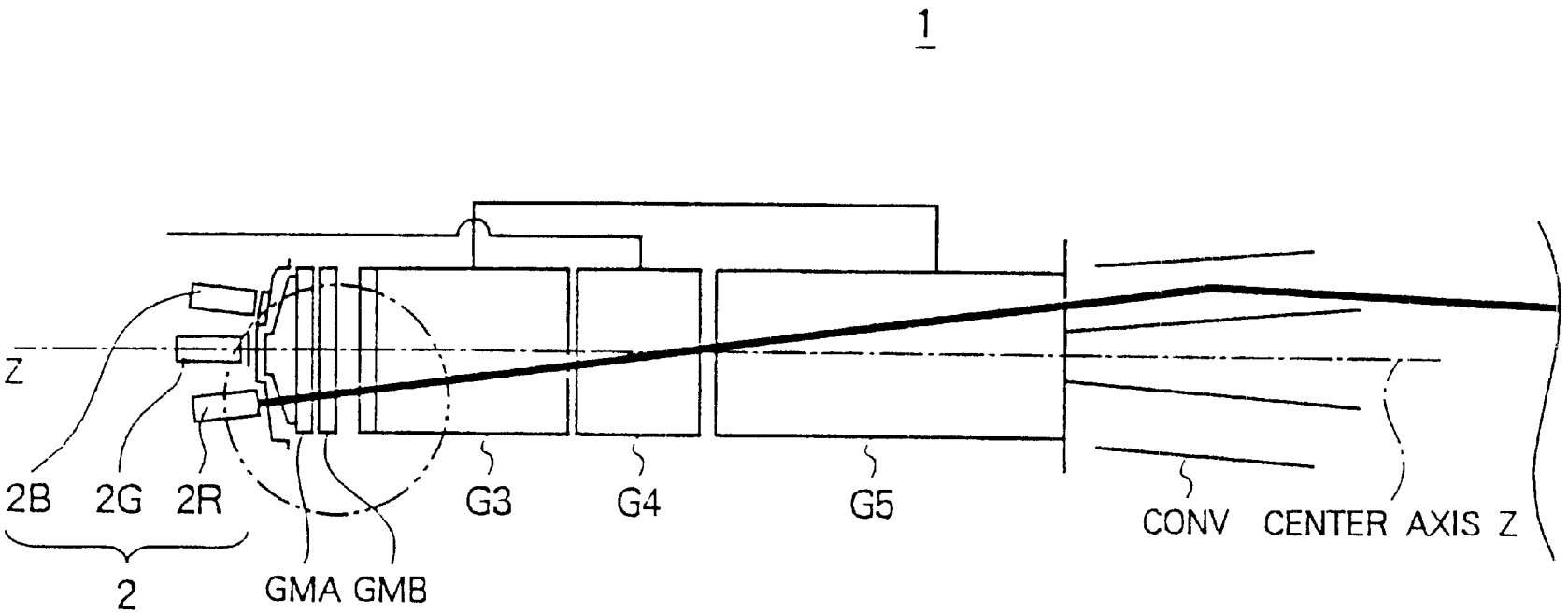
RELATED ART FIG. 4
FIG. 4 is an cross sectional view of a comentional electron gun

Here, the Gla electrode, G2a electrode, GMAa electrode, and GMBa electrode correspond to the G1 electrode, G2 electrode, GMA electrode, and GMB electrode explained above with reference to FIG. 4 and FIG. 5. Further, the G3 electrode, G4 electrode, G5 electrode, and convergence electrode CONV are the same as those explained above with reference to FIG. 4 and FIG. 5.

The electrodes are affixed at predetermined bead glass and are provided with three openings (beam through holes) through which the red, blue, and green electron beams pass. For example, as shown in FIG. 2 the GMAa electrode and the GMBa electrode are provided with the beam through holes 29A and 29B for passing the red electron beam, the beam through holes 20A and 20B for passing the green electron beam, and the beam through holes (not shown) for passing the blue electron beam.

Here, the Gla electrode is, for example, supplied with 0V voltage. To simplify the structure, it is formed integrally with the cathode 12. Note that the cathode 12 is supplied with 40 to 170V.

The G2a electrode, GMAa electrode, GMBa electrode, and G3 electrode cooperate to form a prefocus lens.

Note that the G2a electrode is supplied with 500V, the GMaa electrode is supplied with 7000V, the GMBa electrode is supplied with 7000V, and the G3 electrode is supplied with 29,000V. Here, the voltage supplied to one of the GMA electrode and the GMB electrode is fixed, while the voltage supplied to the other is variable. In FIG. 2 distance L11 between the emission surface of the cathode 12G and the Gla electrode is about 0.1 mm, the distance L12 between the Gla electrode and the G2*a* electrode is about 0.4 mm, the distance L13 between the G2*a* electrode and the GMAa electrode is about 1 mm, the distance L14 between the GMAa electrode and the GMBa electrode is about 0.5 mm, and the distance L15 between the GMBa electrode and the left side end of the G3 electrode in the figure is about 2.0 mm.

The GMAa electrode and the GMBa electrode form a quadrupole lens for correcting the aspect ratio of the cross-section of the electron beam spot in order to obtain a good electron beam spot over the entire region of the phosphor screen, that is, a good focus characteristic. That is, the electron beam spot is corrected by the electric field generated by the potential difference between the GMAa electrode and the GMBa electrode.

Here, the GNBa electrode is affixed to a cup-shaped shaped or tubular conductive member 60 with conductivity as a electron beam orienting means at the downstream side of the paths of the electron beams so as to surround the beam through holes 29A 29B and 30A 30B and beam through which the red electron beam passes.

The conductive member 60 is held at the same potential as the GMBa electrode. The red and blue electron beams passing through the GMBa electrode are oriented toward the center axis Z by the potential difference generated between the conductive member 60 and G3 electrode. By this, the red, green, and blue electron beams are suitably made to cross in the G4 electrode.

The G3 electrode, G4 electrode, and G5 electrode form a large diameter main focus lens (main lens) about which the beams cross. The red and blue electron beams cross, then spread out toward the outside and are deflected by the convergence electrode CONV to pass through the aperture grille 22 and converge at the three-color phosphor screen. 21

The action of the electron gun 11 will be explained next.

The green electron beam emitted from the cathode 12G passes through the Gla electrode, G2*a* electrode, GMAa electrode, GMBa electrode, G3 electrode, G4 electrode, and GS electrode, is converged at the convergence electrode CONV, passes through the aperture grille 22 to reach a predetermined position on the three-color phosphor screen stripes 21, and excites the predetermined phosphors.

Further, the blue electron beam 70 emitted from the cathode 12B passes through the Gla electrode, G2*a* electrode, GMAa electrode, and GMBa electrode in parallel to the center axis Z. At this time, the electron beam 70 enters the beam through holes 29A and 29B of the GMAa electrode and GMBa electrode perpendicularly (from the front).

Next, it passes through the GMAa electrode and the GMBa electrode, then is oriented toward the center axis Z by the electric field produced by the potential difference between the conductive member 60 and the G3 electrode provided downstream of the GMBa electrode. At this time, the angle of orientation when the electron beam 70 is oriented toward the center axis Z is determined by the potential difference between the cup-shaped conductive member 60 and the G3 electrode.

Next, it passes through the G3 electrode, crosses with the green and red electron beams in the G4 electrode, then passes through the G5 electrode, is converged by the convergence electrode CONV, passes through the aperture grille 22, reaches the predetermined position on the three-color phosphor screen stripes 21, and excites the predetermined phosphors.

Note that the electron beam emitted from the cathode 12R, like the blue electron beam 70 emitted from the cathode 12B, is oriented toward the center axis Z by the cup-shaped conductive member 60 and excites the predetermined phosphors through the aperture grille 22 and convergence electrode CONV.

As explained above, according to the electron gun 11 and color cathode ray tube 23 of the present invention, since a mechanism for orienting the electron beams from the cathodes 12 to make them cross, that is, the cup-shaped conductive member 60, is provided at the downstream side of the quadrupole lens formed by the GMAa electrode and GNBa electrode, it is possible to arrange all of the cathodes 12R, 12G, and 12B in parallel with respect to the center axis Z and make the red, green, and blue electron beams strike the quadrupole lens from the front. Therefore, it is possible to make the clearance between the beam through holes of the GMAa electrode and the GMBa electrode and the beam paths larger, eliminate the optical aberration, and obtain a sufficient focus characteristic.

Further, since there is a large clearance between the beam through holes and the beam paths in this way, the degree of design freedom becomes higher. That is, the sensitivity to axial deviation of the beam through holes to the path of the electron beams can be reduced.

Further, the step of placement of the cathodes 12R, 12G, and 12B in the manufacturing process becomes simple and the cost can be lowered.

The present invention is not limited to the above embodiment. For example, the shape of the electrodes and the distance between electrodes are not limited to those explained above.

Further, in the above embodiment, the case was shown of formation of the conductive member 60 integrally with the GMBa electrode, but it is also possible to provide a cup-shaped member 60 to be supplied with the predetermined voltage independently at the downstream side of the GMBa electrode.

Again, as explained above, according to the color cathode ray tube and electron gun of the present invention, it is possible to make the three electron beams strike the quadrupole lens from the front. Therefore, it is possible to make the clearance between the beam through holes of the electrodes and the beam paths larger, eliminate the optical aberration, and obtain a sufficient focus characteristic.

Further, since there is a large clearance between the beam through holes and the beam paths in this way, the degree of design freedom becomes higher. That is, the sensitivity to axial deviation of the beam through holes to the path of the electron beams can be reduced.

Further, the step of placement of the cathode in the manufacturing process becomes simple and the cost can be lowered.

What is claimed is:

1. An electron gun for a color cathode ray tube, comprising:

an electron beam emitter for emitting three electron beams;

a quadrupole lens;

a cup shaped electron beam orienting means; and high voltage electrodes forming a main lens;

wherein said electron beam orienting means is disposed between said quadrupole lens and said main lens, and orients two side electron beams toward a center electron beam so that said three electron beams emitted from said emitter cross in said main lens.

2. An electron gun for a color cathode ray tube as set forth in claim 1, wherein said electron beam emitter is comprised of three cathodes arranged side by side so as to emit the three electron beams parallel to each other.

3. An electron gun for a color cathode ray tube as set forth in claim 2, wherein said orienting means is a conductive member to which a predetermined voltage is supplied and which orients said electron beams by a potential difference with said high voltage electrodes.

4. An electron gun for a color cathode ray tube as set forth in claim 1, wherein said quadrupole lens is formed by at least a first intermediate voltage electrode and a second intermediate voltage electrode provided at a downstream side of a path of said electron beams from said first intermediate voltage electrode.

5. An electron gun for a color cathode ray tube as set forth in claim 4, wherein said orienting means is a conductive tube provided so as to surround beam through-holes in said second intermediate voltage electrode on a side of said second intermediate voltage electrode from which said electron beams emerge.

6. An electron gun for a color cathode ray tube as set forth in claim 1, wherein said electron beam emitter comprises a single electron gun that emits said three electron beams.

7. A cathode ray tube comprising electron beams emitted from an electron gun so as to selectively strike a three-color phosphor screen, wherein said electron gun comprises:

an electron beam emitter for emitting three electron beams;

a quadrupole lens;

high voltage electrodes forming a main lens, and an a cup shaped electron beam orienting means disposed between said quadrupole lens and said main lens which orients two side electron beams toward a center electron beam so that said three electron beams emitted from said emitter cross in said main lens.

8. A color cathode ray tube as set forth in claim 7, wherein said electron beam emitter is comprised of three cathodes arranged side by side so as to emit the three electron beams parallel to each other.

9. A color cathode ray tube as set forth in claim 8, wherein said orienting means is a conductive member to which a predetermined voltage is supplied and which orients said electron beams by a potential difference with said high voltage electrodes.

10. A color cathode ray tube as set forth in claim 7, wherein said quadrupole lens is formed by at least a first intermediate voltage electrode and a second intermediate voltage electrode provided at a downstream side of a path of said electron beams from said first intermediate voltage electrode.

11. A color cathode ray tube as set forth in claim 10, wherein said orienting means is a conductive tube provided so as to surround beam through-holes in said second intermediate voltage electrode on a side of said second intermediate voltage electrode from which said electron beams emerge.

12. A color cathode ray tube as set forth in claim 7, wherein said electron beam emitter comprises a single electron gun that emits said three electron beams.

13. An electron gun for a color cathode ray tube as set forth in claim 3, wherein said quadrupole lens is formed by at least a first intermediate voltage electrode and a second intermediate voltage electrode, said conductive member of said orienting means being held at voltage which is equal to a voltage at which said second intermediate voltage electrode is held.

14. An electron gun for a color cathode ray tube as set forth in claim 3, wherein said second intermediate voltage electrode and said conductive member of said orienting means are integrally formed.

15. An electron gun for a color cathode ray tube, comprising:

an electron beam emitter for emitting three electron beams;

a quadrupole lens through which said electron beams are passed;

high voltage electrodes forming a main lens through which said electron beams are passed; and a cup shaped conductive member disposed between said quadrupole lens and said main lens for converging said electron beams so that said electron beams cross in said main lens.

16. An electron gun for a color cathode ray tube as set forth in claim 15, wherein said electron beam emitter is comprised of three cathodes arranged parallel to each other so as to emit said three electron beams parallel to each other.

17. An electron gun for a color cathode ray tube as set forth in claim 16, wherein said conductive member is held at a predetermined voltage and converges said electron beams by a potential difference with said high voltage electrodes.

18. An electron gun for a color cathode ray tube as set forth in claim 15, wherein said quadrupole lens is formed by at least a first intermediate voltage electrode and a second intermediate voltage electrode.

19. An electron gun for a color cathode ray tube as set forth in claim 18, wherein said conductive member is a conductive tube provided so as to surround beam through-holes in said second intermediate voltage electrode on a side of said second intermediate voltage electrode from which said electron beams emerge.

20. An electron gun for a color cathode ray tube as set forth in claim 15, wherein said electron beam emitter comprises a single electron gun that emits said three electron beams.

* * * * *

UNITED STATES PATENT AND TRADEMARK OFFICE

CERTIFICATE OF CORRECTION

PATENT NO. : 6,262,524 B1
DATED : July 17, 2001
INVENTOR(S) : Yoshihiro Ouchi

It is certified that error appears in the above-identified patent and that said Letters Patent is hereby corrected as shown below:

Column 7,
Line 32, delete "an"

Signed and Sealed this

Eighteenth Day of February, 2003

JAMES E. ROGAN
*Director of the United States Patent and Trademark Office*